US008672582B2

(12) United States Patent
Loew et al.

(10) Patent No.: US 8,672,582 B2
(45) Date of Patent: Mar. 18, 2014

(54) MULTIPURPOSE COMPACTOR AND METHOD FOR OPERATING THE MULTIPURPOSE COMPACTOR

(75) Inventors: Timo Loew, Boppard (DE); Alexander Hehner, Patersberg (DE)

(73) Assignee: Bomag GmbH, Boppard (DE)

( * ) Notice: Subject to any disclaimer, the term of this patent is extended or adjusted under 35 U.S.C. 154(b) by 0 days.

(21) Appl. No.: 12/766,466

(22) Filed: Apr. 23, 2010

(65) Prior Publication Data

US 2010/0272512 A1 Oct. 28, 2010

(30) Foreign Application Priority Data

Apr. 23, 2009 (DE) ..... 10 2009 018 621

(51) Int. Cl.
*E01C 19/22* (2006.01)

(52) U.S. Cl.
USPC ..... 404/84.1; 404/84.05

(58) Field of Classification Search
USPC ..... 404/84.05, 84.1, 117, 133.05, 128; 405/271; 701/2; 340/901
See application file for complete search history.

(56) References Cited

U.S. PATENT DOCUMENTS 4,057,805 A * 11/1977 Dowling ..... 340/687
5,450,068 A * 9/1995 Steffen ..... 340/5.74
5,646,844 A * 7/1997 Gudat et al. ..... 701/208
6,047,234 A * 4/2000 Cherveny et al. ..... 701/200
6,226,572 B1 * 5/2001 Tojima et al. ..... 701/23
6,285,925 B1 * 9/2001 Steffen ..... 701/2
6,516,267 B1 * 2/2003 Cherveny et al. ..... 701/208
6,853,913 B2 * 2/2005 Cherveny et al. ..... 701/208
6,997,648 B2 * 2/2006 Steffen ..... 405/271
7,002,461 B2 * 2/2006 Duncan et al. ..... 340/505
7,491,014 B2 * 2/2009 Sick ..... 404/133.1
7,881,868 B2 * 2/2011 Greene et al. ..... 701/301
7,932,809 B2 * 4/2011 Nair et al. ..... 340/5.2
8,115,650 B2 * 2/2012 Dasilva et al. ..... 340/686.6
8,195,366 B2 * 6/2012 McCabe et al. ..... 701/50
2008/0071429 A1 * 3/2008 Kraimer et al. ..... 701/2
2008/0189000 A1 * 8/2008 Duong ..... 701/20
2008/0208395 A1 * 8/2008 Self et al. ..... 701/2
2009/0214300 A1 * 8/2009 Birgisson et al. ..... 405/271
2010/0018726 A1 * 1/2010 Chiocco ..... 172/1
2010/0063651 A1 * 3/2010 Anderson ..... 701/2
2010/0094482 A1 * 4/2010 Schofield et al. ..... 701/2
2010/0289662 A1 * 11/2010 Dasilva et al. ..... 340/686.6

FOREIGN PATENT DOCUMENTS

DE 42 21 793 C1 2/1994
WO 99/21153 A1 4/1999

* cited by examiner

*Primary Examiner* — Gary Hartmann
(74) *Attorney, Agent, or Firm* — Baker & Hostetler LLP

(57) ABSTRACT

A multipurpose compactor with an automatic safety system is provided. The automatic safety system comprises at least one transmitter and one receiver. The transmitter is coupled mechanically fixed to the multipurpose compactor and/or to a unit movable relative to the multipurpose compactor. The receiver is coupled fixedly to the movable unit and/or the multipurpose compactor.

7 Claims, 4 Drawing Sheets

MULTIPURPOSE COMPACTOR AND METHOD FOR OPERATING THE MULTIPURPOSE COMPACTOR

CROSS-REFERENCE TO RELATED APPLICATIONS

This application claims priority to foreign Patent Application DE 10 2009 018621.2, filed on Apr. 23, 2009, the disclosure of which is incorporated herein by reference in its entirety.

FIELD OF THE INVENTION

The present invention relates to a multipurpose compactor having a safety system and a method for operating multipurpose compactor.

BACKGROUND OF THE INVENTION

A multipurpose compactor is suitable in particular for compacting cohesive soils in trenching, in channel and pipeline construction, in railway and embankment construction, for construction back filling, in landfill construction, and for substructure and foundation work. Furthermore, the multipurpose compactor can be used as a trench roller, for example, for compaction work in the case of road and landscape design, road making, and also in the case of large areas.

Equipping a multipurpose compactor with a remote control, via which the multipurpose compactor is remote controllable, is known. The remote control can communicate with the multipurpose compactor via a cable or wirelessly. In order that an operator of the multipurpose compactor, who controls the multipurpose compactor via the remote control in particular, is not in danger of being run over entirely or at least partially by the multipurpose compactor, a safety system is typically provided. For example, the safety system comprises one, preferably two emergency stop levers, which form the frontmost and/or rearmost end of the multipurpose compactor and which cause an emergency stop upon contact with a resistance. It is thus ensured that the multipurpose compactor stops immediately and does not cause damage in the event of bumping the operator or another person on the construction site.

Safety systems which can estimate distances with the help of infrared (IR) or ultrasonic sensors are known too. By means of measuring the delay or the intensity of signals the distances can be calculated. It turned out that these systems used on construction sites are interference-prone due to dirt, unintended reflections etc. and that they can only observe a relatively narrow area due to the directional characteristic of transmitters and receivers. Therefore, these systems are not adequate for multipurpose compactors on construction sites.

SUMMARY OF THE INVENTION

Embodiments of the present invention advantageously provide a multipurpose compactor and a method for operating the multipurpose compactor, which effectively contribute to particularly safe operation of the multipurpose compactor.

The present invention is distinguished according to a first aspect by a multipurpose compactor having a safety system. The safety system comprises at least one transmitter and one receiver. The transmitter is coupled mechanically fixed to the multipurpose compactor and/or a unit movable relative to the multipurpose compactor. The receiver is coupled fixedly to the movable unit and/or the multipurpose compactor. In this context, this means that the receiver is fixedly coupled to the movable unit, if the multipurpose compactor is coupled to the transmitter, and the receiver is fixedly coupled to the multipurpose compactor if the movable unit is fixedly coupled to the transmitter. Furthermore, the multipurpose compactor and/or the movable unit may also each have one receiver and one transmitter.

The transmitter and the receiver make it possible to monitor whether the movable unit maintains a minimum distance to the multipurpose compactor, and to automatically initiate at least one safety measure if the minimum distance is not maintained. This can contribute particularly effectively to safe operation of the multipurpose compactor, in particular if the unit movable relative to the multipurpose compactor is carried by a person, such as an operator of the multipurpose compactor, and the safety distance of the operator to the multipurpose compactor is thus monitored. If the distance falls below this safety distance, at least one safety measure, such as a drive stop, is preferably initiated.

The design of the automatic safety system according to the invention is based on RFID technology (radio-frequency identification). IR radiation usually covers a frequency range from 0.3 to 385 THz. In contrast, the safety system according to the invention works with electromagnetic waves in the LF-range (low-frequency), i.e. within a range of 30 to 300 kHz and preferably with a frequency of 125 kHz. In contrast to systems that use IR radiation or ultrasonic waves whose protective or safety fields exhibit clear directional characteristics, the safety system is characterized in that the protective field is emitted nearly spherically from around the transmitter. The spherical propagation of the protective field enables a wide-ranging, direction-independent protection of the operator when the transmitters and/or antennas are suitably positioned on the machine. The safety system is thus preferably based on RFID technology with an active transponder.

As, in contrast to IR radiation or ultrasonic sound, no "intervisibility" is necessary between transmitters and receivers, there is no need to arrange the transmitters visibly "on" the machine. Rather, the transmitters can also be arranged "in" or "inside" the machine, thus resulting in further advantages with respect to the protection of transmitters from dirt, damage during operation, vandalism and manipulation.

Contrary to conventional systems that are based on the analysis of reflected signals, the safety system according to the invention enables interference-free operation, as e.g. reflections at the trench wall or other extraneous light influences do not play a role. This represents a considerable practical advantage.

Preferably, the protective fields in front of and behind the machine are coded in such a manner that it is only possible to stop the machine from travelling in the direction of the operator. Unnecessary halting of the machine can thus be avoided. The machine can thus move away from the operator, even if the latter is within the protective field. Moreover, as long as the machine is travelling forward, the operator can approach the machine from the rear without directly stopping the machine.

In an advantageous embodiment, the unit movable relative to the multipurpose compactor is comprised by a remote control of the multipurpose compactor. This effectively contributes to the operator, who uses the remote control, being protected from an injury by the multipurpose compactor, because a use of the unit movable relative to the multipurpose compactor can be forgotten by the operator if it is embodied independently of the remote control. Alternatively or additionally, the unit movable relative to the multipurpose compactor may also be implemented independently of the remote control, however. For example, persons who are located in the hazard area in addition to the operator may be equipped with one or more further corresponding movable units.

In a further advantageous embodiment, the transmitter is coupled to at least one transmitting antenna. The transmitter and the transmitting antenna are implemented so that they emit a protective field, which has a predefined radius. This contributes in a simple way to monitoring the safety distance, which preferably essentially corresponds to the predefined radius. In particular, the predefined radius can be between 0.5 and 2 m, for example.

In a further advantageous embodiment, the transmitter is coupled to two transmitting antennas. One of the two transmitting antennas is situated in a front area of the multipurpose compactor in the main travel direction of the multipurpose compactor and the other transmitting antenna is situated in a rear area of the multipurpose compactor in the main travel direction of the multipurpose compactor. This allows two safety distances in front of and behind the multipurpose compactor to be monitored independently of one another in a simple manner. Furthermore, different safety measures may be used, for example, if multiple persons having movable units move inside only one of the two safety distances or both safety distances simultaneously. In addition, one transmitter may be provided for each transmitting antenna.

In a further advantageous embodiment, the receiver is coupled to a receiving antenna. The receiving antenna is implemented so that it receives the protective field independently of its location and/or orientation. This contributes in a simple manner to particularly safe operation of the multipurpose compactor, because a person having the movable unit who is facing away from the multipurpose compactor or lying on the ground is also recognized by the safety system.

In a further advantageous embodiment, the safety system is electronically coupled to a control unit of the multipurpose compactor so that a drive of the multipurpose compactor can be shut off as a function of a safety signal of the safety system via the control unit. Alternatively or additionally, the safety system can be directly coupled to a drive of the multipurpose compactor so that the safety system can shut off and/or block the drive independently of the control unit. For example, the safety system can act directly on hydraulic valves of the drive. This allows stopping of the multipurpose compactor in case of danger in a simple and particularly reliable way.

The invention is distinguished according to a second aspect by a method for operating the multipurpose compactor. The protective field is emitted by the transmitter and the safety signal is generated by the receiver if the receiver is located inside the protective field. Furthermore, the safety signal is transmitted from the unit movable relative to the multipurpose compactor to the multipurpose compactor if the receiver is comprised by the unit movable relative to the multipurpose compactor.

The safety signal is preferably only generated and/or the drive of the multipurpose compactor is only stopped if the unit movable relative to the multipurpose compactor is located in the travel direction of the multipurpose compactor. This contributes in a simple manner to the multipurpose compactor not being stopped unnecessarily, if a person equipped with the movable unit moves inside the safety distance opposite to the travel direction.

In a further advantageous embodiment, after the automatic stopping of the drive, the drive is only released in the direction opposite to the original travel direction. Alternatively or additionally, the drive is only released when the movable unit is no longer located inside the protective field. This contributes in a simple manner to a further hazardous situation not being provided immediately after avoiding a first hazardous situation after the multipurpose compactor is put back into operation.

In a further advantageous embodiment, a self-test of the safety system is performed automatically. The drive of the multipurpose compactor is blocked if the self-test result is negative. This contributes in a simple manner to a particularly safe operation of the multipurpose compactor, in particular if the safety system is defective.

BRIEF DESCRIPTION OF THE DRAWINGS

Exemplary embodiments of the invention are explained in greater detail hereafter on the basis of schematic drawings. In the figures.

DETAILED DESCRIPTION

Figure 1:
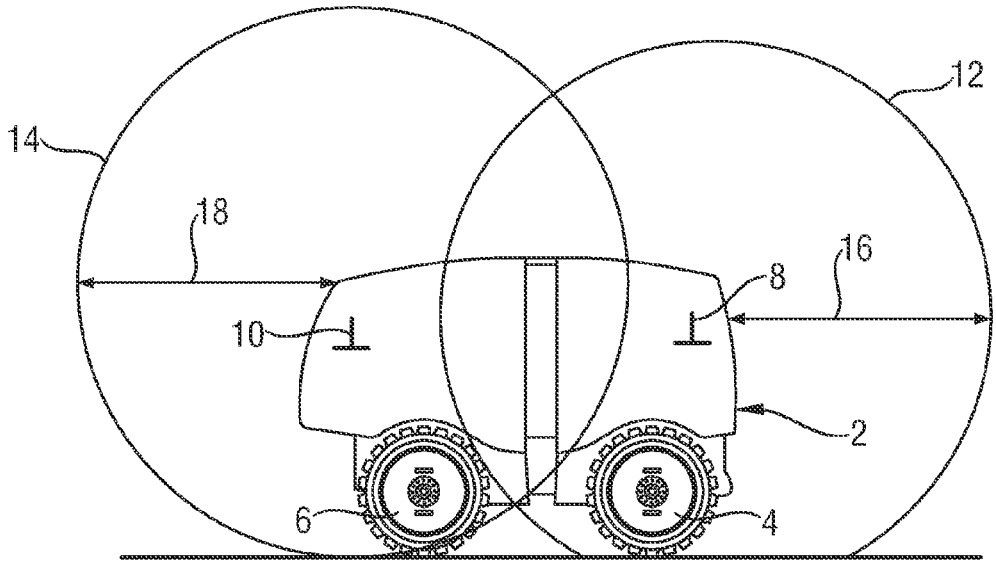
FIG. 1 shows a side view of a multipurpose compactor.

Embodiments of the present invention provide a multipurpose compactor 2 (FIG. 1) that comprises a front and a rear roller 4, 6. The multipurpose compactor 2 is suitable for compacting soil on greatly varying construction sites. For example, the multipurpose compactor 2 can be used in building construction, underground construction, and/or in road construction. Furthermore, the multipurpose compactor 2 can also be used as a trench roller. In order to meet various requirements as a function of its use, the rollers 4, 6 may be replaceable, for example.

Figure 2:
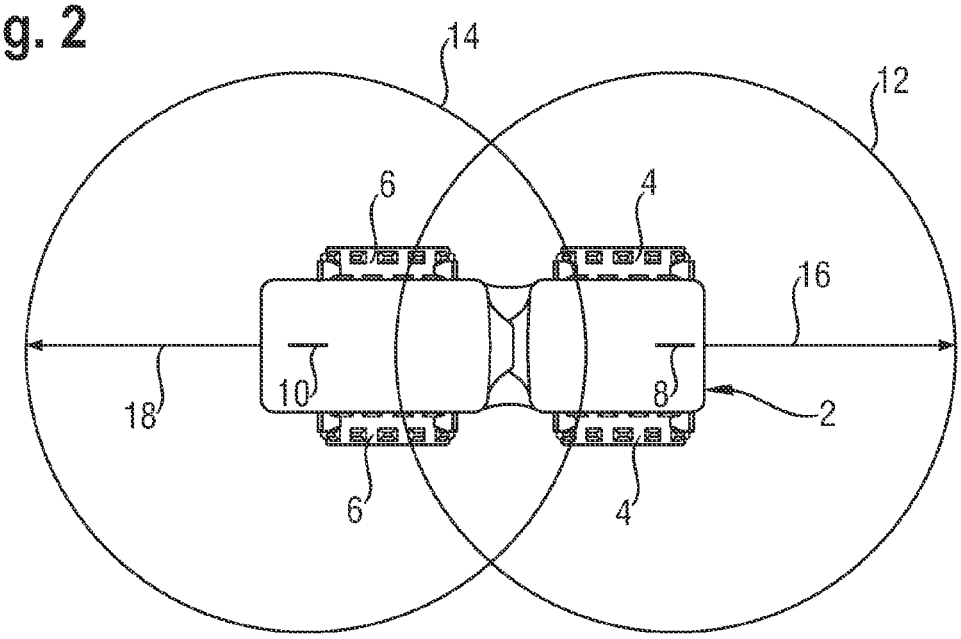
FIG. 2 shows a top view of the multipurpose compactor.

The multipurpose compactor 2 is equipped with a safety system, which prevents complete or partial running over of persons, in particular an operator of the multipurpose compactor 2. The safety system comprises at least two parts, of which a first mechanical part is fixedly coupled to the multipurpose compactor 2. This part of the safety system coupled mechanically fixed to the multipurpose compactor 2 preferably comprises a transmitter, which is installed in the multipurpose compactor 2, and at least one transmitting antenna, which is electrically coupled to the transmitter. However, the safety system preferably comprises at least one first transmitting antenna 8, which is situated in a front area of the multipurpose compactor 2 in relation to a main travel direction of the multipurpose compactor 2, and a second transmitting antenna 10, which is situated in a rear area of the multipurpose compactor 2 in relation to the main travel direction of the multipurpose compactor 2. The first transmitting antenna 8 emits a first protective field 12 having a first predefined radius 16 and the second transmitting antenna 10 emits a second protective field 14 having a second predefined radius 18. The two predefined radii 16, 18 may be predefined differently or may correspond to one another. The two protective fields 12, 14 are typically emitted in a sphere (FIG. 2).

Figure 3:
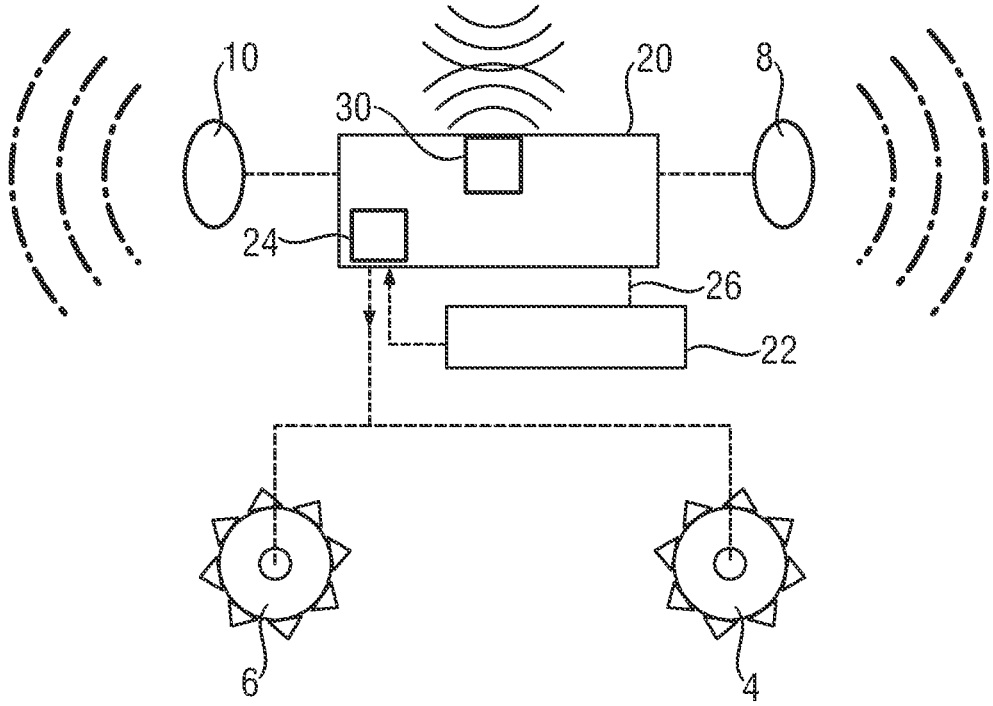
FIG. 3 shows a schematic illustration of a first part of a safety system of the multipurpose compactor.

The transmitter of the first part of the safety system is comprised by a protective field controller 20 of the safety system (FIG. 3), for example. The protective field controller is coupled to the transmitting antennas 8, 10 and must be equipped with an additional transceiver device 30. Furthermore, the protective field controller 20 is coupled to a control unit 22 for controlling a drive of the multipurpose compactor 2, for example, via a CAN bus 26. The protective field controller 20 can act via a circuit 24 directly and/or indirectly via the control unit 22 and the circuit 24 on a drive of the front and/or rear roller 4, 6 of the multipurpose compactor 2. For example, the protective field controller 20 can directly switch, in particular shut off, one or more hydraulic valves of the drive of the multipurpose compactor 2.

The protective field controller 20 can have, in addition to the circuit 24 and the transceiver device 30, a processor having a memory chip, such as an EEPROM, an RFID chip, a high-frequency transceiver, a CAN transceiver, one or more drivers, and a power supply unit or a voltage transformer. The protective fields 12, 14 may be emitted on a carrier frequency of 125 kHz at a data rate of 4 kilobits per second, for example. Furthermore, the protective fields 12, 14 may be turned on and off cyclically, a time duration during which the two protective fields 12, 14 are turned off being selected so that no safety risk thus arises. Furthermore, the radii 16, 18 of the protective fields 12, 14 may be settable, for example, by a manufacturer of the multipurpose compactor 2. A field number is preferably transmitted on the carrier frequency of the protective fields 12, 14, which is representative of whether the corresponding protective field 12, 14 is the first or the second protective field 12, 14, a system UID, which is permanently defined by the manufacturer during the production of the protective field controller 20 and stored in the EEPROM of the control unit 20, and optionally a checksum, on the basis of which the transmitted data can be checked.

Figure 4:
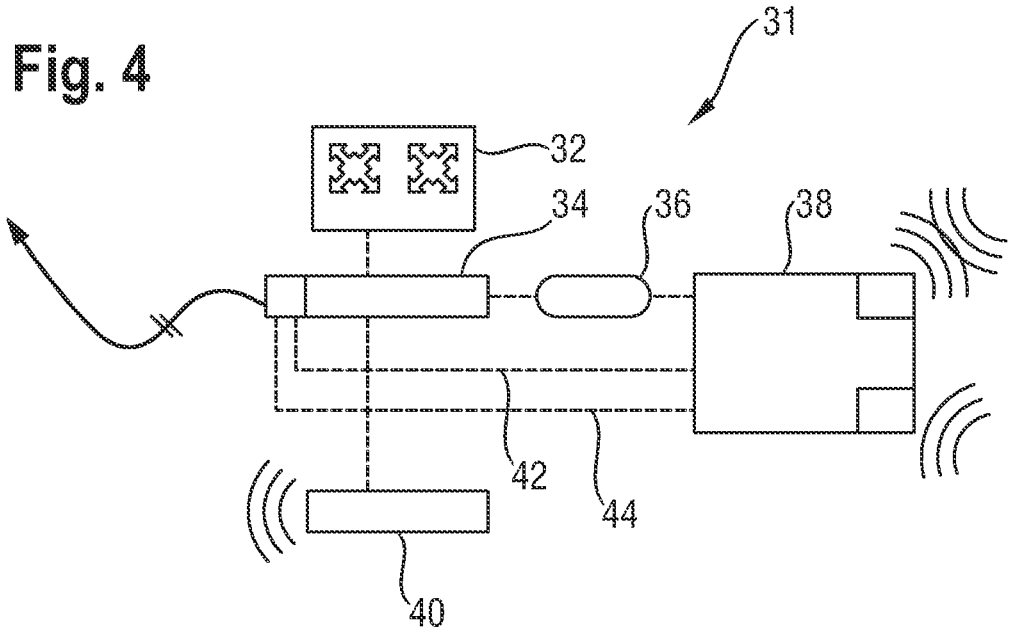
FIG. 4 shows a schematic illustration of a second part of the safety system.
Figure 5:
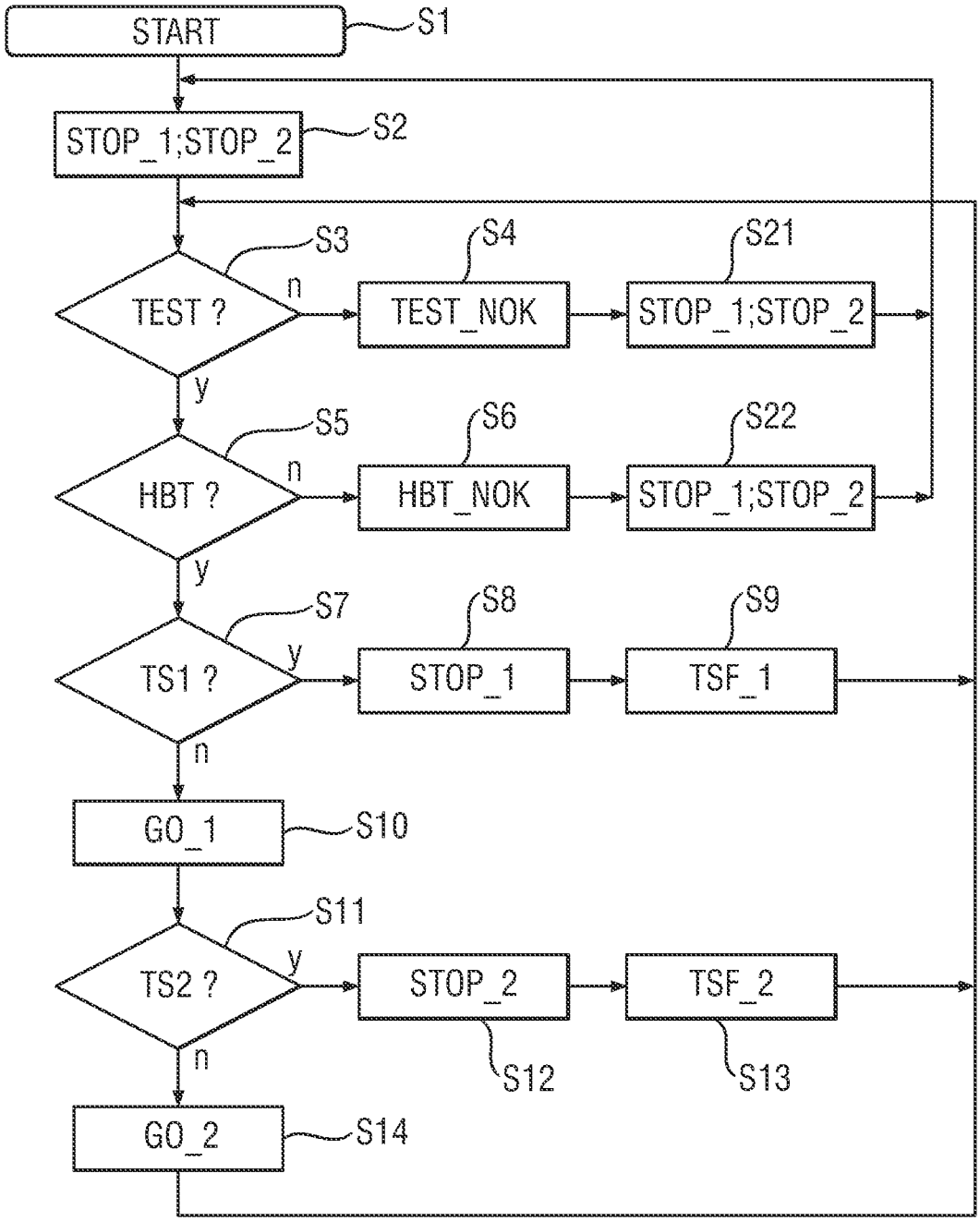
FIG. 5 shows a flowchart of a program for operating the first part of the safety system.
Figure 6:
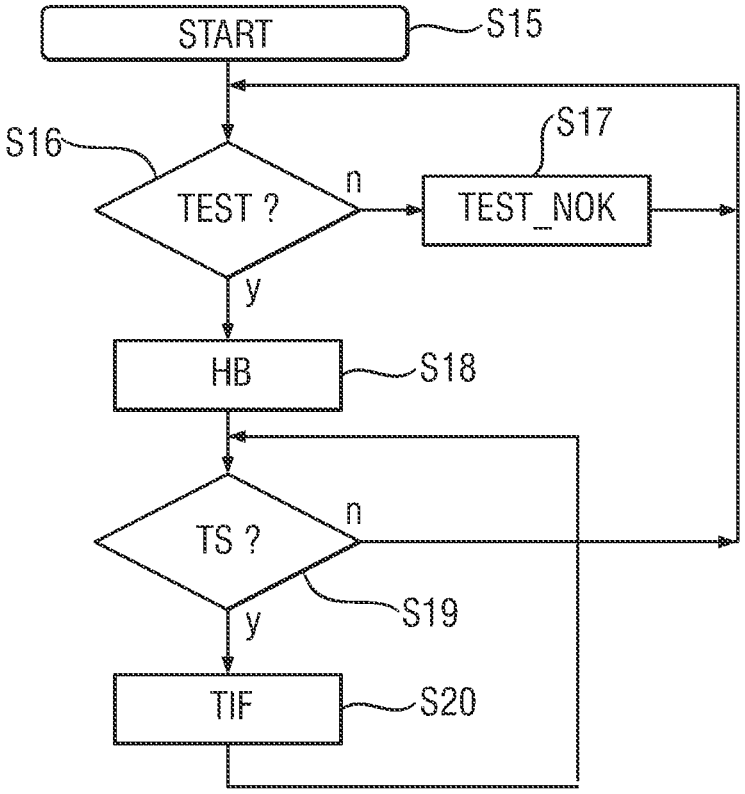
FIG. 6 shows a flowchart of a program for operating the second part of the safety system.

A second part of the safety system is formed by a unit movable relative to the multipurpose compactor 2. The unit movable relative to the multipurpose compactor 2 is, for example, a component of a remote control 31 (FIG. 4) of the multipurpose compactor. Alternatively or additionally, the unit movable relative to the multipurpose compactor 2 can be implemented independently of the remote control 31, for example, in the form of a check card, a plug, and/or a fob, in particular a key fob. However, it is particularly preferable for at least the remote control 31 to be equipped with this mobile unit, because this contributes particularly effectively to the protection of the operator, who operates the multipurpose compactor 2 via the remote control 31.

The remote control 31 comprises an operating console 32, which is coupled to a remote control module 34. Furthermore, the remote control 31 comprises a battery 36, which is coupled to the remote control module 34 and to a transceiver device 38, which can also be designated as an active transponder.

The transceiver device 38 of the remote control 31 is coupled via a CAN bus 42 to the remote control 31 and via a power cable 44 to the remote control module 34. In addition, the remote control module 34 is coupled to a radio transmitter 40.

The remote control 31 can be coupled to the multipurpose compactor 2 via a cable and thus control it without the radio transmitter 40. Alternatively thereto, the remote control 31 can be implemented so that the multipurpose compactor 2 is controllable wirelessly, in particular via the radio transmitter 40.

The second part of the safety system particularly comprises the transceiver device 38 of the remote control 31, which preferably comprises a 3-D antenna, an RFID chip, a processor, a high-frequency transceiver, a CAN transceiver, and/or a power supply unit or a voltage transformer. The 3-D antenna is implemented so that it allows recognition of the first or second protective field 12, 14 independently of an orientation and/or location of the mobile unit. The processor of the transceiver device 30 preferably comprises an EEPROM.

The transceiver device 38 transmits on a carrier frequency of 868 MHz, for example. The data transmission is performed at regular intervals and upon entry into one of the two protective fields 12, 14. A range of the transceiver device 38 can be selected as relatively large, for example, 30 to 40, in particular 35 m. During the regular data transmission, an identification code, which is representative for the corresponding mobile unit, and a checksum for checking the identification code are emitted at regular intervals. Upon entry into the protective fields 12, 14, the field number, the system UID, and the corresponding checksum are preferably emitted. Alternatively to the carrier frequency of 868 MHz, for example, a carrier frequency of 916 MHz or 2.4 GHz can also be used.

A first program for monitoring the multipurpose compactor 2 is preferably stored on a storage medium of the protective field controller 20. The first program is used for the purpose of regularly performing a self-test of the first part of the safety system and checking whether a safety risk exists. A drive of the multipurpose compactor 2 can optionally be automatically stopped using the first program.

The first program is started in a step S1, for example, in which variables are optionally initialized, for example, close in time to a start of the multipurpose compactor 2.

In a step S2, a first and a second drive stop command Stop_1, Stop_2 are preferably generated, which block the drive if the drive of the multipurpose compactor 2 is already stopped and stop the drive if the multipurpose compactor 2 is currently being driven.

In a step S3, it is checked using a test command TEST whether the protective field controller 20 functions perfectly. In particular, a range test of the two transmitting antenna 16, 18, a test of the output of the circuit 24, a CAN interface test, and a test of the EEPROM of the protective field controller 20 can be performed. In the case of the range test of the two transmitting antennas 16, 18, the level of the resonant circuit voltage can be checked, because this represents a measure of the range of low-frequency radio waves. Furthermore, defective antennas, damping, wire breaks, and/or short-circuits may be reliably recognized. During the check of the circuit 24, two independent relays may optionally be checked, which may cause stopping or blocking of the drive in one travel direction each. A correspondence between a current activation and a position of the corresponding relay contacts may be checked by feedback of the logic level at the switch pin. The CAN interface can be checked using a test command. In the case of the EEPROM, the data can be stored multiple times, for example, two or three times, and the plausibility of the data stored multiple times can be checked during the test of the EEPROM. Furthermore, a perfect execution of the software can be checked with the aid of a watchdog and/or reset IC. If the self-test is not successful, the processing is preferably continued in a step S4. If the test of step S3 is successful, the processing is continued in a step S5.

In step S4, a self-test fault command TEST_NOK is generated, which is representative of the fact that the self-test has had a negative result. In step S21, a first and a second drive stop command STOP_1, STOP_2 are generated and the drives are stopped in both drive directions via the second shutdown pathway.

It is checked in step S5 whether the identification code emitted according to the interval of the transceiver device 38 of the second part of the safety system is in order. If this check has a negative result, the processing is continued in a step S6. If this check is positive, the processing is continued in a step S7.

In step S6, an identification code fault command HBT_NOK is generated, which is representative of the fact that the identification code of the movable unit is not transmitted correctly or is not received correctly. In step S22, a first and a second drive stop command STOP_1, STOP_2 are generated and the drives are stopped in both drive directions via the second shutdown pathway.

In a step S7, it is checked using a first test command TS1 whether the movable unit is located in the first protective field 12. If the check in step S7 has a positive result, the processing is continued in a step S8. If the check in step S7 has a negative result, the check is continued in the step S10.

The first drive stop command Stop_1 is generated according to step S2 of the first program in step S8.

In a step S9, a first CAN-info TSF_1 is emitted, which is representative of the fact that the movable unit is located in the first protective field 12.

In step S10, the drive of the multipurpose compactor 2 is released in the main travel direction using a first drive command GO_1.

In a step S11, it is checked using a second test command TS_2 whether the movable unit is located in the second protective field 18. If the check of step S11 has a positive result, the processing is continued in a step S12. If the check in step S11 has a negative result, the check is continued in a step S14.

In step S12, the second drive stop command Stop_2 is generated according to step S2 of the first program.

In a step S13, a second CAN-info TSF_2 is emitted, which is representative of the fact that the movable unit is located in the second protective field 18.

In the step S14, the drive of the multipurpose compactor 2 is released opposite to the main travel direction of the multipurpose compactor 2 using a second drive command GO_2.

The first program is preferably executed regularly during operation of the multipurpose compactor 2 and only ended upon shutdown or close in time to the shutdown of the multipurpose compactor 2.

A second program for operating the multipurpose compactor 2, in particular for operating the second part of the safety system of the multipurpose compactor 2, is stored on the storage medium of the movable unit, in particular the transceiver device 38. The second program is used, as a supplement to the first program, for the purpose of allowing safer work using the multipurpose compactor 2 and in particular informing the first part of the safety system in a timely manner of when the movable unit is located in one of the protective fields 16, 18. The second program is started in a step S15, for example, preferably upon a start of the multipurpose compactor 2 and/or upon the start of the movable unit, in particular the remote control 31. Furthermore, variables are optionally initialized in step S15.

In a step S16, a self-test of the transceiver device 38 of the remote control 31 can be performed using a test command TEST. During the self-test of the transceiver device 38 of the remote control 31, a CAN interface of the CAN bus 42 of the movable unit can be checked, for example, using a test command. Furthermore, the transceiver device 38 of the movable unit can comprise a watchdog and/or a reset IC, which ensure perfect execution of the software. If the check in step S16 has a negative result, the processing is continued in a step S17. If the check in step S16 has a positive result, the processing is continued in a step S18.

In step S17, a self-test fault command TEST_NOK is generated and emitted via the CAN bus 42 of the movable unit and/or via the high-frequency transceiver of the transceiver device 38 of the remote control 31.

In a step S18, the identification code of the movable unit is transmitted according to an interval via the high-frequency transceiver or, in the case of a cable connection to the multipurpose compactor 2, via the CAN buses 42 and 26 of the movable unit and the multipurpose compactor 2.

In a step S19, it is checked using a general test command TS whether the movable unit is located in one of the two protective fields 12, 14. If this check has a negative result, the step S16 is executed again. If this check has a positive result, step S20 is preferably executed.

In step S20, the system UID and the field number are preferably emitted via the CAN buses 26, 42 or via the high-frequency transceiver.

The second program is preferably executed regularly during the operation of the multipurpose compactor, in particular the remote control 31.

The identification code of the movable unit is emitted regularly every 1.5 seconds, for example. The protective field controller 20 is preferably designed so that it causes an operational stop of the multipurpose compactor 2 in the event of a breakdown of the controller caused by manipulation, component failure, or mechanical destruction. If one or more movable units are located in both protective fields 12, 14 simultaneously, the drive of the multipurpose compactor 2 is blocked in both travel directions.

The invention is not restricted to the disclosed exemplary embodiments. For example, a protective field can be emitted by the movable unit which is recognized by the first part of the safety system in the multipurpose compactor 2. Furthermore, the multipurpose compactor 2 can be equipped with only one transmitting antenna. Furthermore, the transceiver device 38 of the movable unit can exclusively be implemented as a receiving unit, the transmission to the first part of the safety system exclusively being able to be performed via the radio transmitter 40 or the cable connection between the remote control 31 and the multipurpose compactor 2. Furthermore, any further possible combination of transmitter and receiver in the multipurpose compactor 2 and/or the unit movable relative thereto is conceivable, by which moving inside a safety distance of the movable unit toward the multipurpose compactor 2 is recognizable using high-frequency, middle-frequency, and low-frequency radio waves.

The many features and advantages of the invention are apparent from the detailed specification, and, thus, it is intended by the appended claims to cover all such features and advantages of the invention which fall within the true spirit and scope of the invention. Further, since numerous modifications and variations will readily occur to those skilled in the art, it is not desired to limit the invention to the exact construction and operation illustrated and described, and, accordingly, all suitable modifications and equivalents may be resorted to that fall within the scope of the invention.

What is claimed is:

1. An automatic safety system comprising:

a multipurpose compactor including at least one transmitter fixedly coupled thereto; and a movable unit including a transceiver configured to transmit an identification code at a time interval fixedly coupled thereto, wherein the transceiver utilizes radio-frequency identification (RFID) technology to communicate with the at least one transmitter and causes the multipurpose compactor to stop when the identification code is not transmitted;

wherein the at least one transmitter is adapted to emit a spherical propagation of a protective field for a direction independent protection of an operator, and wherein an identification code fault command is generated which is representative of the fact that the identification code of the movable unit is not transmitted correctly or is not received correctly, whereby a first and a second drive stop command is generated to stop the drives in both drive directions via a second shutdown pathway.

2. The automatic safety system according to claim 1, wherein the movable unit relative to the multipurpose compactor comprises a remote control of the multipurpose compactor.

3. The automatic safety system according to claim 1, wherein the at least one transmitter is coupled to at least one transmitting antenna, and the at least one transmitter and the at least one transmitting antenna emit a protective field that has a predefined radius.

4. The automatic safety system according to claim 3, wherein the at least one transmitter is coupled to two transmitting antennas that are situated in a front or rear area, respectively, of the multipurpose compactor in a main travel direction of the multipurpose compactor.

5. The automatic safety system according to claim 4, wherein at least one the transmitter is provided for each of the two transmitting antennas.

6. The automatic safety system according to claim 3, wherein the transceiver is coupled to a receiving antenna—that receives the protective field independently of location and/or orientation.

7. The automatic safety system according to claim 1, wherein the automatic safety system is electronically coupled to a control unit of the multipurpose compactor so that a drive of the multipurpose compactor can be shut down as a function of a safety signal of the automatic safety system, or the automatic safety system is directly coupled to the drive of the multipurpose compactor so that the drive of the multipurpose compactor can be shut down directly as a function of the safety signal independently of the control unit.

* * * * *